US005628365A

United States Patent [19]

Belonenko

[11] Patent Number: 5,628,365

[45] Date of Patent: May 13, 1997

[54] METHOD OF PRODUCING GAS FROM FLUID CONTAINING BEDS

[75] Inventor: Vladimir N. Belonenko, Moskovskaya, Russian Federation

[73] Assignee: Aktsionernoe Obschestvo Zakrytogo Tipa "Biotekhinvest", Moscow, Russian Federation

[21] Appl. No.: 495,888

[22] Filed: Jun. 28, 1995

[30] Foreign Application Priority Data

Dec. 28, 1992 [RU] Russian Federation ..... 92014732/03

[51] Int. Cl.[6] ..... E21B 43/14; E21B 43/25

[52] U.S. Cl. ..... 166/249; 166/177.6; 166/369; 166/370

[58] Field of Search ..... 166/177.1, 177.2, 166/177.6, 177.7, 249, 369, 370

[56] References Cited

U.S. PATENT DOCUMENTS

| | | | |
|---|---|---|---|
| 3,497,005 | 2/1970 | Pelopsky et al. | 166/249 X |
| 4,060,128 | 11/1977 | Wallace | 166/249 |
| 4,199,028 | 4/1980 | Caughey | 166/370 |
| 4,417,621 | 11/1983 | Medlin et al. | 166/249 |
| 4,702,315 | 10/1987 | Bodine | 166/249 |
| 5,133,411 | 7/1992 | Gedelle et al. | 166/370 |
| 5,450,899 | 9/1995 | Belonenko et al. | 166/249 X |

FOREIGN PATENT DOCUMENTS

| | | |
|---|---|---|
| 1596081 | 9/1980 | U.S.S.R. . |
| 1030538 | 7/1983 | U.S.S.R. . |
| 1240112 | 5/1988 | U.S.S.R. . |
| 1413241 | 7/1988 | U.S.S.R. . |
| 1833458 | 8/1993 | U.S.S.R. . |

OTHER PUBLICATIONS

Reference Book On Oil Production, Sh.K. Gimatudinov, Ed. Moscow 1994 pp. 512–513.

*Primary Examiner*—George A. Suchfield
*Attorney, Agent, or Firm*—Michael N. Meller

[57] ABSTRACT

A method is described for producing gas from fluid-containing formations, including the steps of generating elastic vibrations by a generator and stimulating a fluid-containing formation by the elastic vibrations, extracting gas from a gas trap through a well, the generating step involving the step of increasing frequency of elastic vibrations within a frequency range from 0.1 Hz to 350.0 Hz, followed by the step of reducing the frequency within the same frequency range.

25 Claims, 3 Drawing Sheets

METHOD OF PRODUCING GAS FROM FLUID CONTAINING BEDS

This application is a continuation of PCT/RU93/00316 filed Dec. 27, 1993.

BACKGROUND OF THE INVENTION

1. Field of the Invention

The present invention relates to methods for producing gas and hydrocarbons from fluid containing beds.

2. Description of the Prior Art

It is common knowledge that gas is produced from gas; condensed gas; condensed oil-and-gas- and gas-hydrated deposits. In addition to already formed gas deposits, significant gas resources are contained in aquifers, in soluted, dispersed or isolated in the lenses forms. Significant gas volumes in said forms are also contained in formerly developed deposits wherein gas production has been terminated due to water entering the wells.

The gas phase in the form of traps (lenses) can exist both in formations with an essential bed pressure and in depleted formations.

There are known a number of methods of producing gas from fluid-containing beds, providing pumping out the bed fluid. Thus, there is known a method of gas production, providing transportation of gas along with the bed fluid to the surface with subsequent gas separation (Reference Book on Gas Production, Moscow, Nedra, 1974, pp. 511–512).

There is known another method of increasing a recovery of natural gas from an aquifer, providing drilling of one or more wells in the region of an aquifer, reducing the pressure in the bed by pumping out a part of the bed fluid and extracting the released gas (U.S. Pat. No. 4,040,487). This design allows one to avoid gas separation on the earth surface.

There is also known a method of increasing a natural gas recovery from an aquifer having a trap, which differs from the previous one in that the wells are drilled around the trap to a point below the lower boundary thereof. Utilization in this method of a trap as an intermediate reservoir for gas accumulation, makes it possible to compensate a non-uniform removal of the gas from the bed (U.S. Pat. No. 4,116,276).

There is further known a utilization in the fluid hydrocarbon production of a stimulating and intensifying influence on the bed by means of elastic pressure waves generated by appropriate sources in a medium contacting the bed and/or directly in the bed.

In the known methods are utilized the low-amplitude elastic vibrations generated in a seismic frequency range from 0.1 to 500 Hz (U.S. Pat. No. 4,417,621) and pumping gas ($CO_2$) to the bed. Also, there is used a pulse influence by electric discharge devices arranged in a well (U.S. Pat. No. 4,169,503; U.S. Pat. No. 5,004,050).

Moreover, the utilization of seismic vibrations stimulates gas flow through the bed.

There is known a method of producing gas from fluid containing beds having at least one gas trap, providing influencing the bed by means of elastic vibrations generated directly in the bed and/or in a medium contacting the bed by an oscillation source, and removal of the gas from the trap (PCT/RU 92/00025).

Said technical solution, combining influence on the fluid containing bed by means of elastic vibrations and accumulation of gas released at degassing a trap, gives a possibility to use on an industrial scale the flooded formations with low bed pressure and also provides extracting gas from gas containing aquifers.

SUMMARY OF THE INVENTION

An object of the present invention is to increase the efficiency and extent of producing gas from gas containing beds having dissipated through the bed hydrocarbons and underfilled gas traps.

As a result of utilizing the present invention, the volume of gas production from the aquifers and its intensity are raised.

This object is attained by providing a method of producing gas from fluid containing beds having at least one gas trap, consisting in influencing the bed by means of elastic vibrations generated directly in the bed and/or in a medium contacting the bed by an oscillation source and removal of the gas from the trap, wherein the source oscillation frequency during the influence is varied from a minimum value to a maximum one and vice versa within the frequency range from 0.1 to 350 Hz.

The present method can be implemented in various embodiments which supplement the method without changing the essence thereof.

In one of the possible embodiments there is used an additional pressure reduction in the bed or in a part thereof.

The reduction of the pressure is advantageously utilized when the trap has been formed at a high bed pressure.

Alternatively, a source of oscillations can be a source of harmonic oscillations.

Alternatively, a source oscillation frequency can be varied from a minimum value to a maximum one and vice versa, preferably within the frequency range from 1 to 30 Hz.

Alternatively, the source oscillation frequency can be varied in a monotonous and/or discrete way.

Alternatively, the discrete frequency variation can be accompanied by raising the oscillation amplitude.

Alternatively, the source oscillation frequency can be varied in accordance with the harmonic law.

Alternatively, at least one additional source of oscillations can be used.

Alternatively, the additional oscillation source can be a source of harmonic oscillations.

Alternatively, the oscillation sources can operate in phase or out of phase.

Alternatively, at least two oscillation sources can operate in opposite modes of a frequency variation.

Alternatively, the additional oscillation source can be a source of pulse oscillations.

Alternatively, the bed can be additionally influenced by pulses and/or wave trains.

Alternatively, the bed can be additionally influenced by batches of pulses.

Alternatively, the pulse influence can be effected within a half-period of dissipating an elastic wave passing across the bed at a trap region.

Alternatively, the oscillations can be transmitted to the bed by a waveguide comprising a concentrator placed in the bed.

Alternatively, the most intensive influence can be effected at the initial stage of pressure reduction, the rate of reducing the pressure being set at the highest tempo.

Alternatively, the pressure in the bed at the trap region can be reduced until it reaches a value below a pressure of saturation.

Alternatively, the pressure in the bed or a part thereof can be reduced by pumping out the bed fluid from it.

Alternatively, the bed fluid can be pumped out periodically.

Alternatively, the bed fluid can be pumped out from the wells drilled around the trap at a depth exceeding the depth of its lower boundary.

Alternatively, the bed fluid can be pumped out from one bed into another one.

Alternatively, the bed fluid can be pumped out from an underlying bed to an overlying one having a trap.

Alternatively, the bed fluid can be transported to the surface, the heat thereof utilized, and the cooled fluid repumped to the bed, providing an artificial controlled flooding.

All the mentioned above embodiments supplement the present method of producing gas from fluid containing beds having a gas trap, without modifying the essence thereof.

Influencing the bed is effected in order to stimulate and intensify the gas release from the bed. However, it can also serve for some additional purposes, such as to improve an accumulating ability of the bed, to provide a hydrodynamic communication between the beds, etc.

At influencing the bed, the gas, collected in the trap, starts to release increasing the free gas region.

As used in this specification, the term "bed" means primarily a gas-containing aquifer. However, where it is necessary to increase a volume of a gas trap, for instance, in an oil bearing formation, the same measures can be applied also.

The influence can be advantageously effected by means of elastic vibrations, the frequency thereof being varied.

At a low bed pressure at the trap region, a removal of the bed fluid is not necessary. It is sufficient to provide additional degassing of the bed. The pressure in the bed is reduced due to the removal of the gas from the trap.

Tests of various modes of generating the oscillations have shown that the most efficient results of the influence are provided by the methods comprising a variation of the source oscillation frequency from a minimum value to a maximum one and vice versa.

The frequency can be varied in a monotonous and/or discrete way. The discrete (intermittent) frequency variation is accompanied by raising the oscillation amplitude.

Also, the oscillation frequency is varied in accordance with the harmonic law.

Periodic oscillations are accompanied by the influence by means of pulses, batches of pulses and/or wave trains. The pulse influence is advantageously effected at a half-period of dissipating the elastic wave passing across the bed at the trap region.

The above mentioned above modes provide for an intensive gas release, filtration thereof through the porous medium, the most complete recovery of the gas from the bed, and are the most favourable modes for attaining the object of the invention. Moreover, such influences ensure a better penetrability of the beds.

To make the gas discharge process more intensive and to force out water out from exploited wells, the most intensive influence is effected at the initial stage of the pressure reduction, the rate of reducing the pressure being set at the highest tempo.

The oscillation frequency is varied from 0.1 to 350 Hz and from 350 to 0.1 Hz, preferably from 1 to 30 Hz and from 30 to 1 Hz. The oscillations can be transmitted to the bed from a source of harmonic oscillations. Said range of the frequency variation is efficient for influence at a sufficient depth from the earth surface and at a considerable extent of the bed when effecting the influence from the well.

To cover more area and extent of a deposit, the influence is effected by more than one oscillation source. It also allows to attain the most favourable and efficient influence mode, taking into consideration the summation effects, for instance of the in-phase oscillations. In this case, utilization of several oscillation sources results in qualitatively new effects, not defined by simple adding of each source influence effects. The influence can be effected both from the earth surface and from the wells. Oscillations can be transmitted to the bed, for instance, from the earth surface by a waveguide comprising an oscillation concentrator. It promotes raising an extent of the influence efficiency directly in the bed.

It is advisable to reduce pressure in a bed below the saturation pressure level. It provides an essential increase of efficiency of the oscillation influence without further pressure reduction.

The simplest method of reducing pressure in the bed is to pump out the bed fluid from it. The water from the bed can be pumped out both to the earth surface and to another bed.

For instance, the water is pumped out from an underlying bed with higher pressure and temperature to the bed containing a trap. Modification of the pressure-field and temperature characteristics results in releasing gas from the water and in extending the trap volume. The oscillation influence on this process essentially accelerates degassing process and makes it more efficient. Specifically organized oscillation influence mode promotes not only removal of the gas, but also the travel thereof preferably towards the trap, forcing out the water from the exploited wells.

It is possible to provide circulation of the bed fluid from an underlying bed to an overlying one with subsequent repumping it to the underlying bed.

The water is pumped out to the surface, its heat is utilized for various industrial and economical needs, and the cooled water is repumped to the bed providing a regulated artificial flooding. This promotes an increased displacement of the gas from the bed and raises the volume of its production.

In many cases, the pumping out of the water from the bed is not required. When such pumping out is effected, it is advisable to continue it only at a period of a natural head. However, in certain circumstances, when it is justified economically, the bed fluid can be transported compulsorily.

To reduce energy consumption and environmental impact, the bed water is pumped out periodically. Frequency of such pumping out is defined by the efficiency of releasing the gas from the aquifer.

The advantages of the present method consist in that it enables one to exploit on a commercial scale the deposits containing lenses (traps), flooded deposits with low bed pressure, containing residual gas.

The performed tests have shown that a filtration of fluids and, primarily, of a gas phase, when influencing by the elastic waves, is possible even without a provision of a pressure gradient. The present method enables the raising of the gas yield at the most complete gas release from the aquifer during the essentially reduced periods as compared with the prior methods. This method neither requires any pumping out the water, nor is such pumping out performed at an essentially reduced extent, not regularly and during a shorter period of time.

A mechanism of forming the hydrocarbon deposits is closely linked with the natural seismic processes influencing the aquifers. These processes stimulate releasing gas from the aquifers and the travel thereof to the overlying beds. Modification of the thermodynamic conditions (of pressure, temperature and specific volume) of this flow results in shifting the phase balance and releasing from the gas soluted therein hydrocarbons thus forming, as a final result, an oil deposit. In principle, the process of releasing hydrocarbons from the gas solution can take place in each gas bubble. Thereafter, elastic waves promote also a coagulation of dispersed particles, their accumulation in the bed, whether they are gas bubbles or oil drops, their migration through the bed, gravitational segregation and, finally, accumulation of free gas and oil. A duration of this process depends on a lot of factors, for instance, such as the possibility of a seismic influence appearing in this region, level of the seismic background, thermodynamic characteristics of the beds, composition of fluids, etc., and is finally defined by a geological period. The present method provides an essential activization of this process up to forming deposits of hydrocarbons, at least in the local zones.

It is known that each significant gas or oil deposit is genetically linked with a hydrostatic-pressure system taking part in its forming. The present method enables one to develop this link dynamically, to accelerate the process of forming deposits, to enable a commercial exploitation of the deposits containing a lot of traps with low gas volumes, to increase yield of gas and hydrocarbons.

The above-mentioned advantages and peculiarities of the present invention will become apparent in the following detailed description of the preferred embodiments representing the best modes of practicing the invention with references to the accompanying drawings.

DESCRIPTION OF THE PREFERRED EMBODIMENTS OF THE INVENTION

Embodiment No 1 of Practicing the Invention

Figure 1:
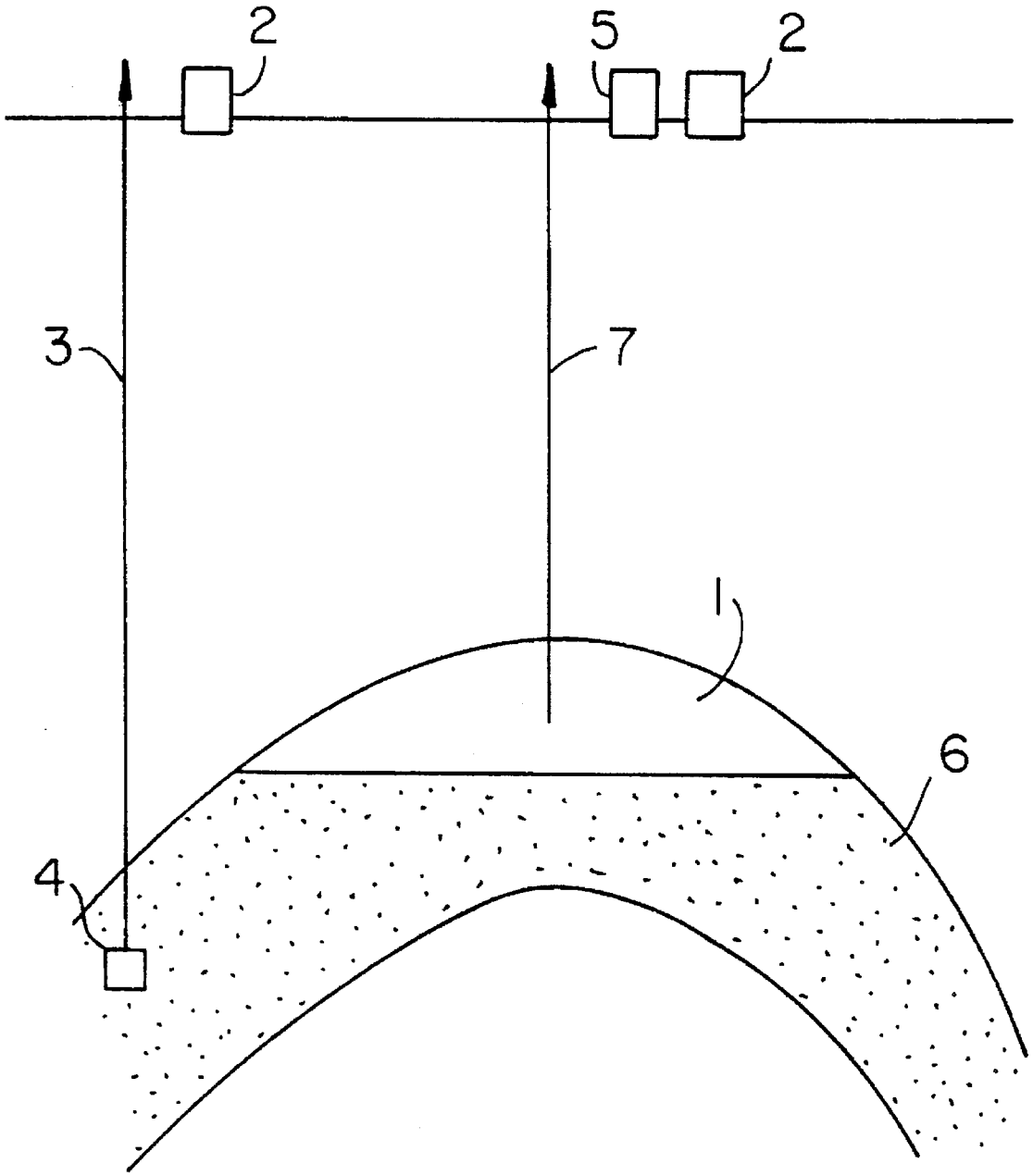
FIG. 1 is a schematic representation of implementing the present method without pumping out the bed fluid.

In the embodiment illustrated in FIG. 1, within a gas trap 1 region are arranged the oscillation sources 2 buried into the soil in order to avoid energy losses for surface waves. In a well 3 there is arranged a pulse influence source 4 of electric discharge action. Said source can be also of some other kind, for instance, a mechanical one of an impact action. Also, at the earth surface is mounted an electromagnetic hammer 5. The sources 2 influence the bed 6 by means of elastic waves, a frequency thereof being varied from 1 to 20 Hz and from 20 to 1 Hz in a discrete way at intervals of 3–5 Hz at one source while the amplitude is increased at each moment of intermittent frequency shift, and from 0.1 to 30 Hz and from 30 to 0.1 Hz, varying it in a monotonous way in accordance with the harmonic law at another source. The sources can operate in phase or out of phase. Also, one source generates waves of an increasing oscillation frequency as the other one generates waves of reducing oscillation frequency. The long waves, generated by the sources, make it possible to influence an aquifer at a considerable depth. The source 5 effects the influence by batches of pulses also from the earth surface. The source 4 effects the pulse influence directly in the bed.

The disclosed operation modes provide the most efficient acceleration of a gas migration, degassing of an aquifer, coagulation of gas bubbles and their travel to the trap 1. Gas is removed from the trap 1 through the well 7. The influence on the bed by the elastic waves results in the secondary effects in the bed as such due to a redistribution of stresses, acoustic emission, etc. It entails an additional dynamic disturbance of the bed, its "sounding" with an essential afteraction. In this case, the bed emits a wide spectrum of frequences sufficient to overlap the frequency spectrum of the degassing process.

Hence, a continuous operation of the oscillation sources is not required and the influence is effected periodically.

Embodiment No 2 of Practicing the Invention

Figure 2:
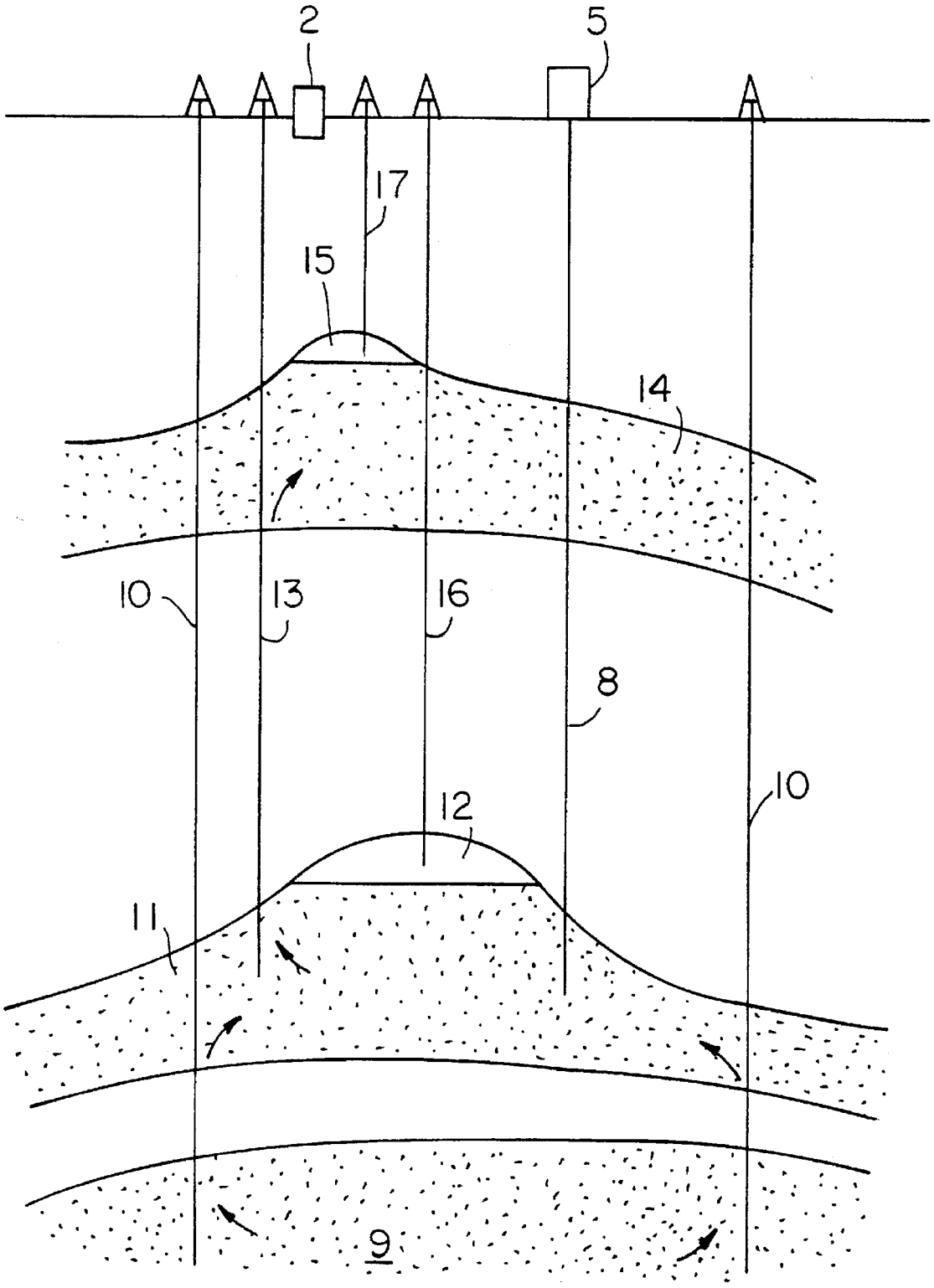
FIG. 2 is a schematic representation of implementing the present method accompanied by pumping out the bed fluid from an underlying bed to a bed containing a trap.

In the embodiment No 2 illustrated in FIG. 2, on the surface there is arranged a source 2 of harmonic oscillations and an electromagnetic hammer 5 over the well 8 in such a way that the pipe string in the well 8 serves as a waveguide. The tail of the Waveguide, arranged in an aquifer, is made in a form of a concentrator. It enables one to raise the intensity of influencing directly in the bed. Water is pumped out from the bed 9 through the wells 10 into the bed 11 containing a trap 12. Owing to the reduction of the pressure and temperature, in the bed 11 starts degassing of the water pumped out from the bed 9 and the introduction of the releasing gas into the trap 12. Similarly, the water is pumped out from the bed 11 through the wells 10 and 13 to an overlying bed 14 wherein a trap 15 is filled by the releasing gas according to the same mechanism. A pressure drop in the bed 11, occuring due to pumping out the water therefrom, leads to even more releasing the gas and filling the trap 12. However, the gas discharge from a solution and an even further pressure drop do not guarantee more or less active gas flow towards the trap in a porous medium. As to the elastic wave influence from the sources 2 and 5, it not only promotes a gas release from the solution, but essentially accelerates the process of filling the traps 12 and 15. This process is the most efficient at a simultaneous pressure reduction and influence by means of the oscillations varying from a minimum frequency level to a maximum one and vice versa within a range from 1 to 150–200 Hz, and an additional influence by means of batches of pulses from the source 5.

Gas is removed from the traps 12 and 15, as they are filled, through the wells 16 and 17. When in the bed 9 appear cavities filled with gas, resulting from pumping out a fluid and the influence, gas is also similarly removed from them.

Embodiment No 3 of Practicing the Invention

Figure 3:
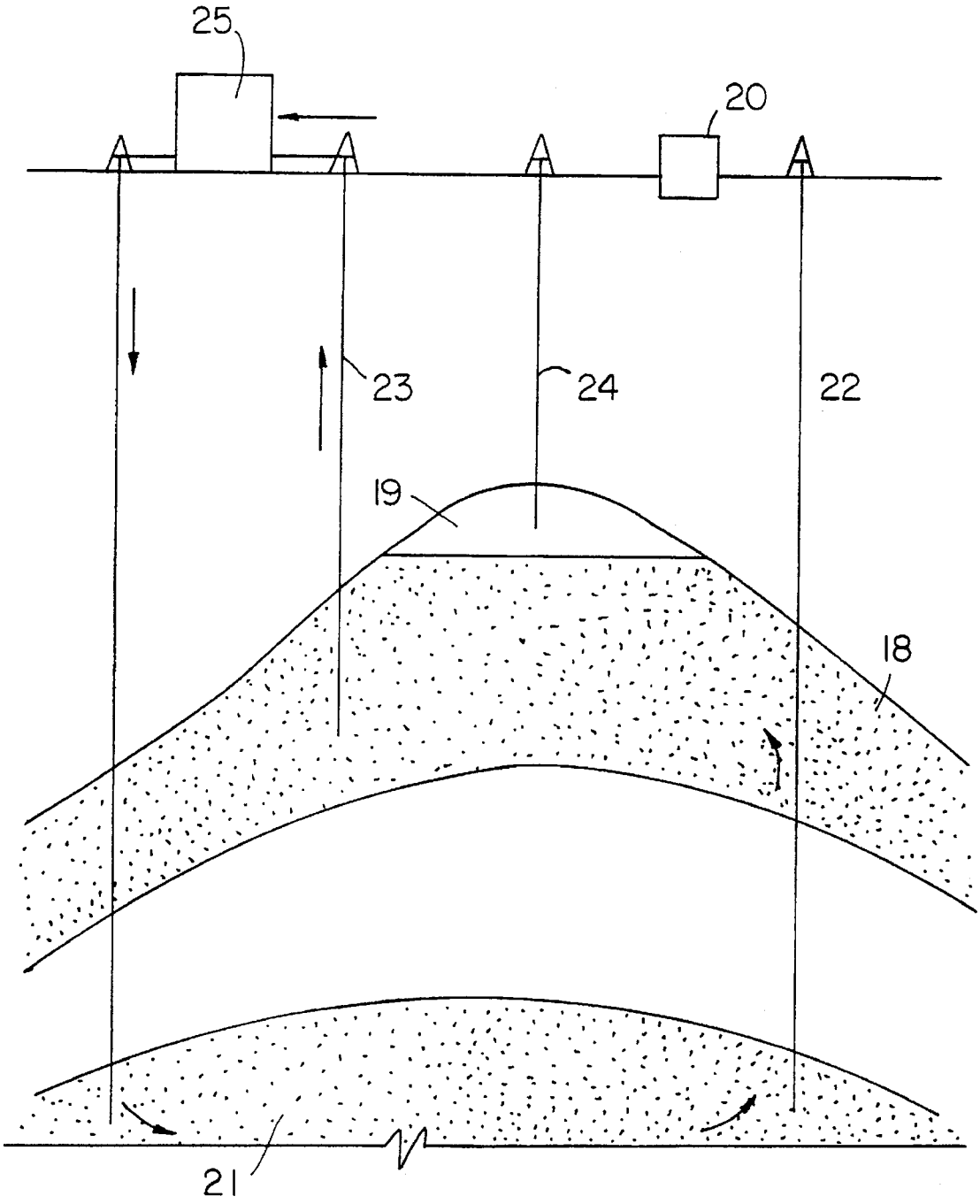
FIG. 3 is a schematic representation of implementing the present method in a closed cycle.

As illustrated in FIG. 3, a source of oscillations 20 is arranged over a bed 18 containing a trap 19. Water from a bed 21 is transported to the bed 18 through a well 22. Modification of the thermodynamic characteristics of a state of the gas-containing water, results in a gas release in the bed 18. Pumping out the water from the bed 18 to the surface through a well 23, drilled aside from the trap 19 and to a point below it, leads to a pressure drop in the bed 18 and to even more degassing the bed fluid. The influence with the harmonic oscillations of the source 20, varying a frequency thereof and alternating or combining them with the influence preferably by means of the wave trains or pulses, essentially accelerates degassing, coagulation of the scattered through the bed bubbles, activating their filtration to the trap 19. Also, the volume of extracted gas is increased. The gas removal from the trap 19 is effected through a well 24. The bed fluid, pumped out to the surface through the well 23, is delivered to a station 25 which serves for utilization of the heat for various technical and economical needs, for instance, for generating electric power. Spent cooled water is pumped to the bed 21 again, and then to the bed 18, promoting an additional displacement of the fluid therefrom and gas release. Said cycle provides a comprehensive utilization of this method advantages and minimum environmental impact.

Repumping of the cooled water to the degassed bed, accompanied by the oscillation influence, allows one to attain a qualitatively new effect in raising efficiency of gas recovery from an aquifer owing to the artificial regulated flooding.

It is provided by that the elastic vibration influence prevents blocking the gas by the water pumped into the bed.

It also raises the rate of impregnating and moving the cold water through the bed, and the rate of heat exchange between the hot and cold fluid. It promotes more rapid cooling of large bed fluid masses and hence, modification of its thermodynamic state properties and release of additional portions of gas from the solution. The elastic waves effect a displacement front, preventing retained gas formation, and if it is formed, the influence in a low frequency spectrum and pulses force it to move with the velocity exceeding the velocity of the front travel (i.e. there appears an additional filtration of gas through the displacement front, forcing the front to move quicker). Then, completeness and rate of gas displacement is increased even more due to a reduction (preferably continuous) of the bed pressure in a gas-hydrocarbon zone.

INDUSTRIAL APPLICABILITY

The claimed method of producing gas from fluid containing beds having a gas trap can be most successfully utilized in a gas recovery from gas containing aquifers, where the gas exists in soluted, dispersed or separated in the lenses forms.

Particularly efficient is an embodiment of the invention, utilizing repumping the bed fluid to the beds having low filtration and capacity abilities.

The effect of the influence is also expressed in that the large mass of gas is removed from the bed at higher average pressure than at just flooding, and essentially higher than without flooding. Therefore, a process of filling the trap with gas at repumping water and the oscillation influence are effected more efficiently which ensures an additional gas production and essential reduction of saturating the bed with residual gas.

Equally, the method can be utilized for the marine deposits.

I claim:

1. A method of producing gas from fluid-containing formations having at least one gas trap, comprising the steps of:

generating elastic vibrations by a main generator and stimulating a fluid-containing formation with the elastic vibrations;

extracting gas from said gas trap through a well;

wherein said generating step comprises increasing the frequency of elastic vibrations within a frequency range from 0.1 Hz to 350.0 Hz, said increasing the frequency of elastic vibrations being followed by reducing the frequency thereof within said frequency range.

2. A method of producing gas as set forth in claim 1, wherein the elastic vibrations are generated in accordance with the harmonic law.

3. A method of producing gas as set forth in claim 1, wherein the increase and reduction of the frequency of elastic vibrations is monotonous.

4. A method of producing gas as set forth in claim 3, wherein, at the monotonous varying of the frequency, the frequency is increased and reduced in accordance with the harmonic law.

5. A method of producing gas as set forth in claim 1, wherein said increase and reduction of the frequency of elastic vibrations is discrete.

6. A method of producing gas as set forth in claim 5, wherein, at the discrete varying of the frequency, an amplitude of said elastic vibrations is increased.

7. A method of producing gas as set forth in claim 1, wherein the frequency of elastic vibrations is increased and reduced within a frequency range from 1.0 to 30.0 Hz.

8. A method of producing gas as set forth in claim 1, wherein the elastic vibrations are generated by an additional generator.

9. A method of producing gas as set forth in claim 8, wherein the elastic vibrations are generated in phase by the main and additional generators.

10. A method of producing gas as set forth in claim 8, wherein the elastic vibrations are generated out of phase by the main and the additional generators.

11. A method of producing gas as set forth in claim 8, wherein in the step of increasing the frequency of the elastic vibrations generated by the main generator, the frequency of elastic vibrations generated by the additional generator is reduced, and in the step of reducing the frequency of the elastic vibrations generated by the main generator, the frequency of elastic vibrations generated by the additional generator is increased.

12. A method producing gas as set forth in claim 11, wherein the elastic vibrations are generated by pulses from an additional pulse generator.

13. A method of producing gas as set forth in claim 12, wherein the fluid-containing formation is stimulated by wave trains.

14. A method of producing gas as set forth in claim 12, wherein the fluid-containing formation is stimulated by pulse batches.

15. A method of producing gas as set forth in claim 12, wherein the elastic vibrations are generated by pulses from an additional pulse generator during a half-period of dissipating the elastic vibrations propagating through the gas trap region from the main generator.

16. A method of producing gas as set forth in claim 1, wherein said main generator is disposed on a daylight area and the fluid containing formation is stimulated by said elastic vibrations through a waveguide with a concentrator mounted on the waveguide in the fluid-containing formation.

17. A method of producing gas as set forth in claim 1, wherein pressure is further reduced in the fluid-containing formation.

18. A method of producing gas as set forth in claim 17, wherein at the beginning of the reducing pressure in the fluid-containing formation, said fluid-containing formation is stimulated with elastic vibrations at the highest intensity of the main generator.

19. A method of producing gas as set forth in claim 18, wherein pressure in the fluid-containing formation within the gas trap region is reduced up to a value lower than that of a saturation pressure of the fluid-containing formation.

20. A method of producing gas as set forth in claim 17, wherein pressure is reduced by pumping out a bed liquid from the fluid-containing formation.

21. A method of producing gas as set forth in claim 20, wherein the bed liquid is pumped out through wells for pumping out, said wells being further drilled around the trap to a depth exceeding the depth of a lower boundary of the gas trap.

22. A method of producing gas as set forth in claim 20, wherein the bed liquid pumped out from the fluid-containing formation is repumped to another formation.

23. A method of producing gas as set forth in claim 20, wherein the bed liquid pumped out from an underlying aquiferous fluid-containing formation is repumped to an overlying fluid-containing formation having a gas trap.

24. A method of producing gas as set forth in claim 23, wherein before repumping the bed liquid to another formation said liquid is transported to the daylight area to utilize the heat thereof, the cooled bed liquid being further repumped to another formation for artificial flooding thereof.

25. A method of producing gas from fluid-containing formations having at lease one gas trap, comprising the steps of:

generating elastic vibrations by a main generator and stimulating a fluid-containing formation with the elastic vibrations;

extracting gas from said gas trap through a well;

wherein said generating step comprises increasing the frequency of elastic vibrations within a frequency range from 0.1 Hz to 350.0 Hz;

said increasing the frequency of elastic vibrations being followed by reducing the frequency thereof within said frequency range;

further drilling wells to an aquiferous fluid-containing formation or bed, having a gas trap;

on the said wells the bed liquid is pumped to the surface to utilize the heat thereof, the cooled bed liquid being further repumped to the said fluid-containing formation, having a gas trap for artificial flooding thereof.

* * * * *